US006103962A

United States Patent [19]

Kirchner

[11] Patent Number: 6,103,962

[45] Date of Patent: Aug. 15, 2000

[54] HUMMINGBIRD WIND CHIME WITH HORIZONTAL WIND BAFFLE AND RIGIDLY ATTACHED STRIKER

[76] Inventor: Mark Louis Kirchner, 5101 N. 10th Pl., Phoenix, Ariz. 85014-3223

[21] Appl. No.: 09/384,663

[22] Filed: Aug. 27, 1999

[51] Int. Cl.[7] ..... G10D 13/08

[52] U.S. Cl. ..... 84/402; 84/403; 84/404

[58] Field of Search ..... 84/402, 403, 404

[56] References Cited

U.S. PATENT DOCUMENTS 4,854,214 8/1989 Lowe .
4,967,633 11/1990 Jewell, Jr. .
5,107,796 4/1992 Embrey .
5,309,809 5/1994 Sambuchi .
5,612,500 3/1997 Liang .
5,648,624 7/1997 Smith ..... 84/404
5,744,736 4/1998 Chang ..... 84/402

*Primary Examiner*—Paul Ip
*Assistant Examiner*—Shih-yung Hsieh

[57] ABSTRACT

A wind chime, which includes an annular array of chimes, a superior horizontal wind baffle positioned above the chime array, a striker, positioned below the wind baffle. The wind baffle is positioned beneath a commercially available hummingbird feeder. Hummingbirds landing, leaving, and hovering at the feeder produce air currents which act on the wind baffle. This action moves the striker into the chimes, which give a tonal response.

2 Claims, 3 Drawing Sheets

HUMMINGBIRD WIND CHIME WITH HORIZONTAL WIND BAFFLE AND RIGIDLY ATTACHED STRIKER

REFERENCE NUMERALS IN DRAWINGS

21*a*. Upper Main Support
21*b*. Main Support Side Arm
21*c*. Bottom Main Chime Support Arms
22 Attachment Loop
23 Hummingbird Feeder Attachment Hook
24 Wind Baffle
25 Striker
26*a* Baffle/Striker Support
26*b* Striker Support
27 Chime
28*a* Chime Support Arm
28*b* Chime Support Arm
28*c* Chime Support Arm
29 Wind Baffle Attachment
30 Tether passthrough Slot
31 Chime Tether
32 Hummingbird Feeder
33 Wind Baffle Mounting Hole
34 Anti-Axial Rotation Pin

BACKGROUND

1. Field of Invention

This invention relates to wind chimes.

2. Description of Prior Art

Originally wind chimes, as disclosed in U.S. Pat. No. 4,967,633, were made with a tethered wind baffle and tethered striker providing independent relative motion of the two. The wind baffle and striker are constrained only by the flexible tether connecting them. Wind baffle is located below the striker and attached to it with a tether. Air movement is converted into movement of the striker using the baffle transferring this movement to the striker across the tether. Other chimes use hummingbird feeders as the strikers. Feeder/Striker chimes, as disclosed in U.S. Pat. No. 5,107,796, are dependent on the momentum imparted by a hummingbird landing and taking off to move the striker/feeder into the chimes. Prior art, as disclosed in U.S. Pat. Nos. 4,967,633 & 5,107,796, does not use the air current force created by the flying hummingbird to move the striker into the chimes as a result of this force on the air baffle. Hummingbird chimes, as disclosed in U.S. Pat. No. 5,107,796, consisting of a plurality of Striker/feeders increases the amount of maintenance required filling and cleaning the feeders.

SUMMARY

A wind chime mounted beneath a commercially available hummingbird feeder. The chime air baffle is located horizontally directly beneath the hummingbird feeder capturing the air currents generated by flying hummingbirds arriving, leaving, or hovering. A striker is mounted to the baffle with a rigid member. The baffle will then move the striker into the chimes as hummingbirds arrive, leave, or hover at the feeder.

OBJECTS AND ADVANTAGES

Accordingly Several Objects and Advantages of my invention are:

A. Provides a mechanism by which hummingbirds can strike chimes at times when natural air currents would not otherwise move the wind baffle/striker.

B. Natural air currents also move the striker into the chimes.

C. Hummingbird feeder can be removed for refilling and maintenance without removing hummingbird chime from overhead structure.

D. This invention uses a single commercial nectar reservoir per wind chime with a plurality of chimes reducing maintenance.

DRAWING FIGURES

DESCRIPTION FIGS. 1, 2, AND 3—PREFERRED EMBODIMENT

Figure 1:
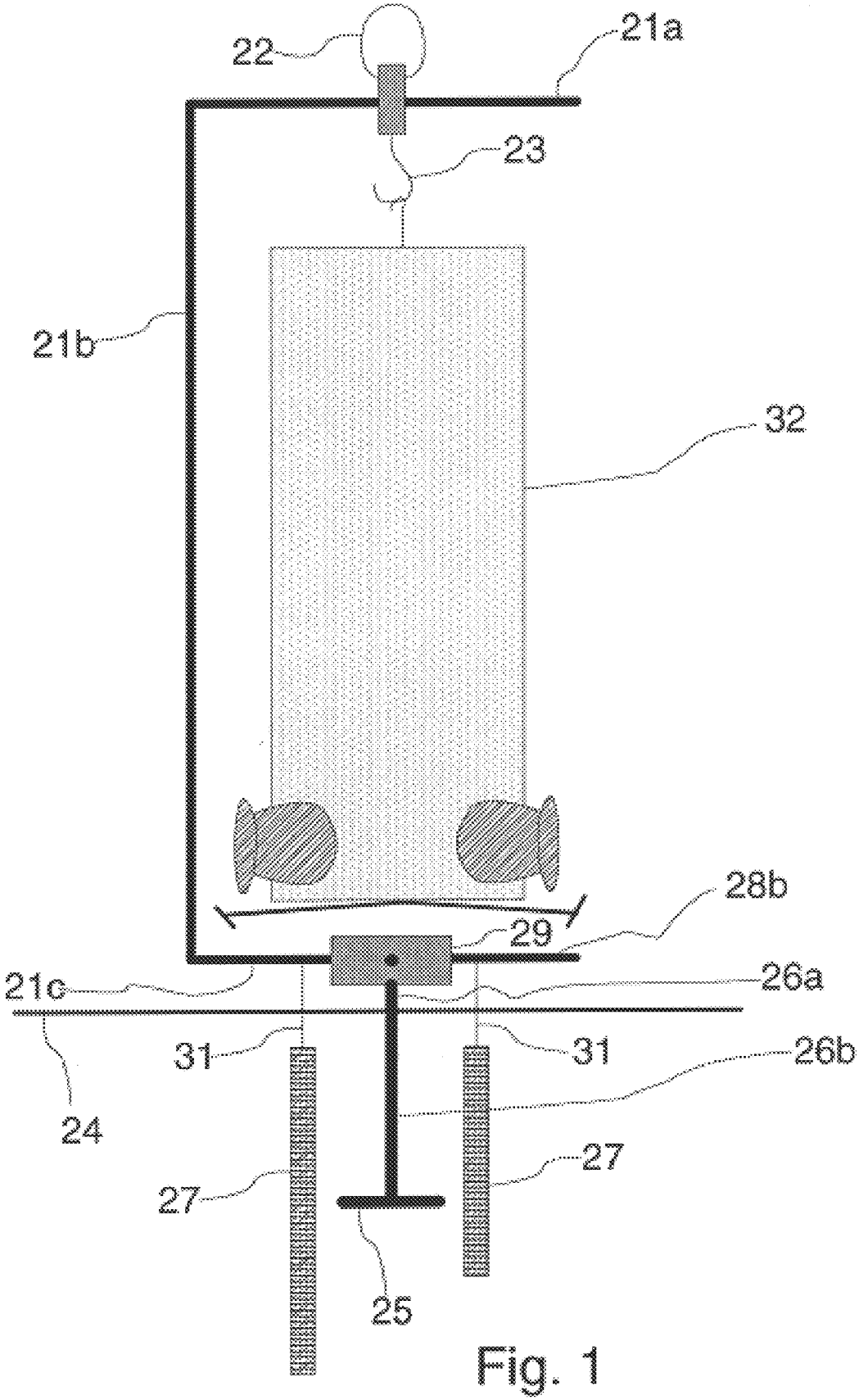
FIG. 1 is a side view of my invention showing the complete assembly with the wind baffle and striker orientation to the chimes.
Figure 3:
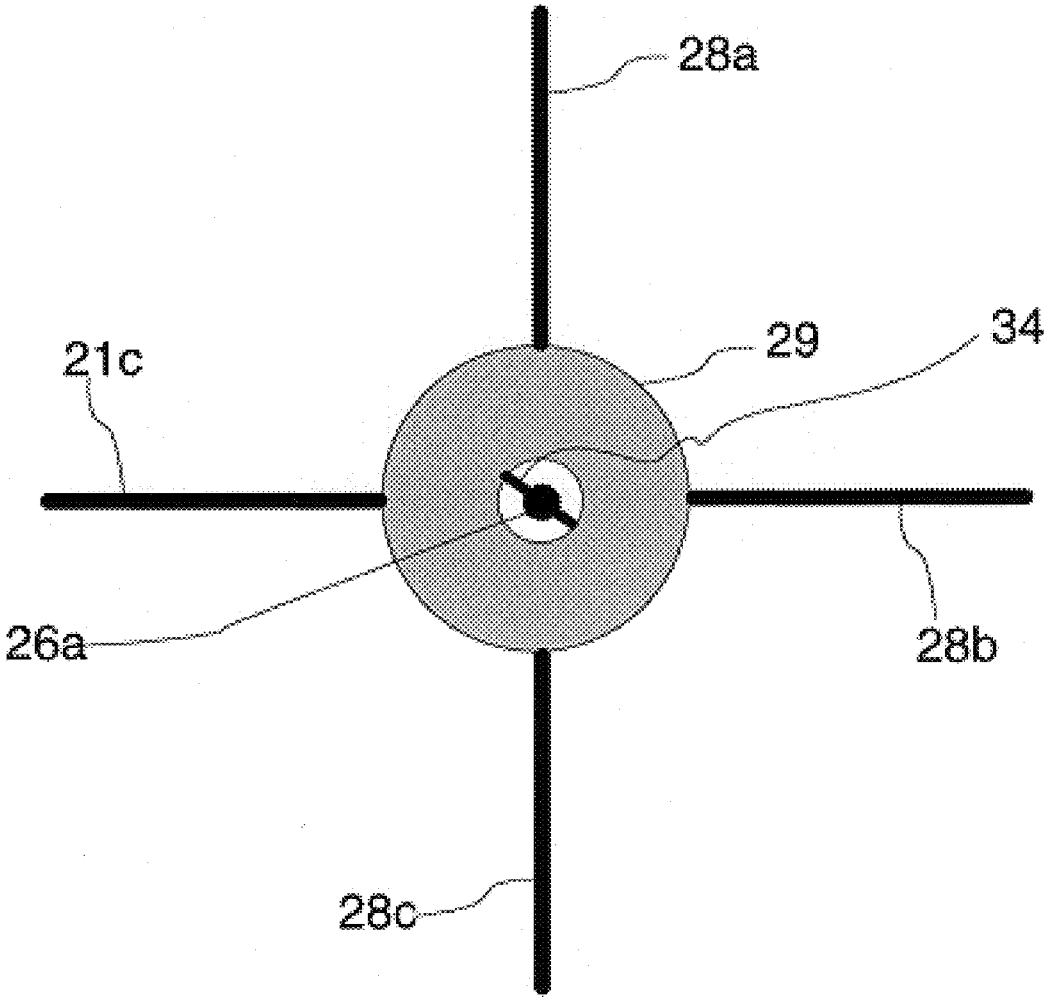
FIG. 3 is a top view of the bottom main chime support showing the anti-axial rotation pin.

FIG. 1 shows a side perspective of the Hummingbird Wind Chime with Superior Horizontal Wind Baffle and Rigidly attached Striker comprised of a Upper main support 21*a* with a attachment loop 22 to suspend it from an overhead hook attachment. A hummingbird feeder attachment hook 23 is located underneath attachment loop providing the hanging attachment for hummingbird feeder 32. A main support side arm 21*b* of length sufficient to accommodate hummingbird feeder 32. main support side arm 21*b* is connected from Upper main support 21*a* to bottom main chime support arms 21*c*. Bottom main chime support arm 21*c* extends in the same direction and plane as Upper main support 21*a* and is perpendicular to main support side arm 21*b*. Wind baffle attachment 29 is located at the center of the overall length of bottom main chime support arm 21*c* and chime support arm 28*b*. Wind baffle attachment 29 provides attachment for chime support arm 28*a*, chime support arm 28*b*, chime support arm 28*c* and wind baffle support 26*a*. FIG. 3 shows a top view of bottom main chime support arm 21*c*, chime support arm 28*a*, chime support arm 28*b*, chime support arm 28*c* and wind baffle attachment 29. Wind baffle attachment 29 connects to bottom main chime support arm 21*c*. Wind baffle attachment 29 provides the connection for wind baffle support 26*a*, chime support arm 28*a*, chime support arm 28*b* and chime support arm 28*c*.

Figure 2:
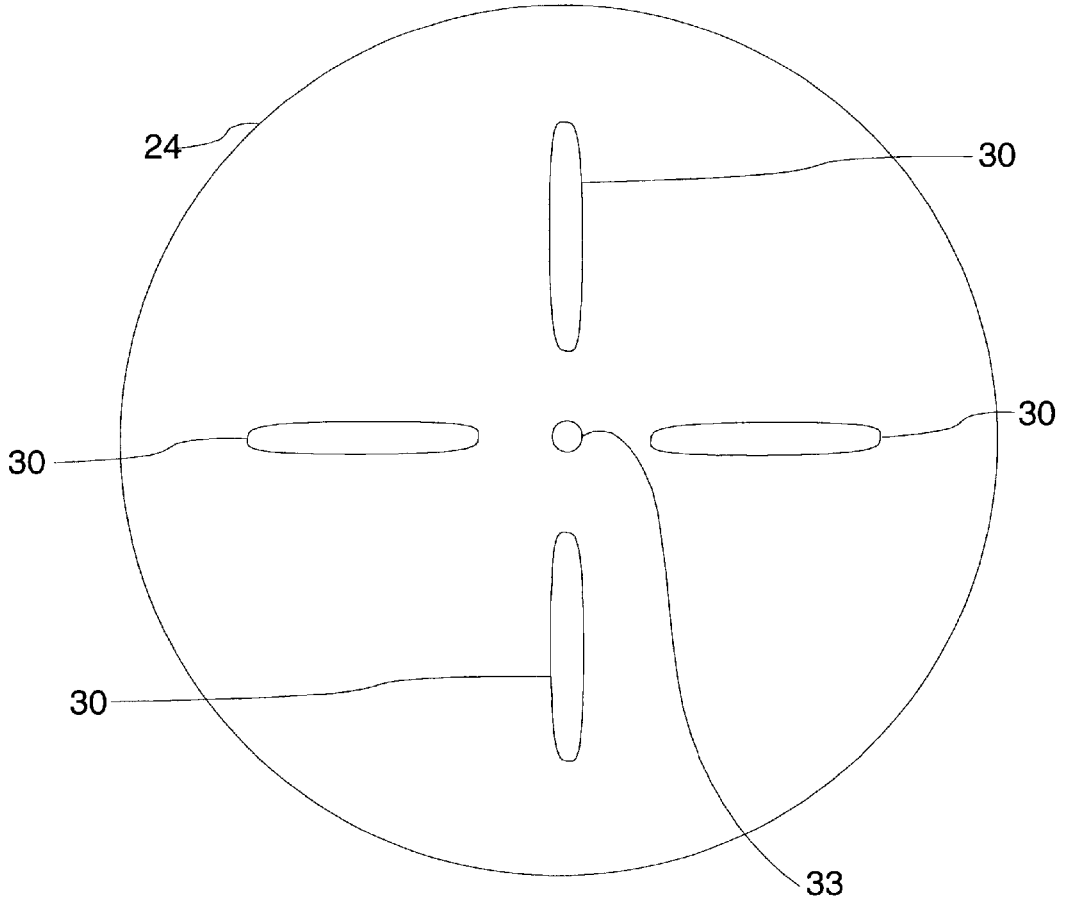
FIG. 2 is a top view of the wind baffle showing the tether pass through slots.

In FIG. 2 the top view of superior horizontal wind baffle 24shows a multiplicity of tether passthrough slot 30, and wind baffle mounting hole 33. FIG. 3 shows wind baffle support 26*a* is attached to wind baffle attachment 29 with anti-axial rotation pin 34, which prevents wind baffle support 26*a* from axial rotation.

In FIG. 1 superior horizontal wind baffle 24 is shown connected between wind baffle support 26*a* and striker support 26*b* with threaded connector (not shown) using the wind baffle mounting hole 33. Distance between the plane of superior horizontal wind baffle 24 to the bottom main chime support arm 21*c*, chime support arm 28*a*, chime support arm 28*b*, and chime support arm 28*c* plane is keep to a minimum. The shorter this distance the better but still allowing the superior horizontal wind baffle 24, and striker 25 assembly to swing sufficiently to strike chime 27.

In FIG. 1 a striker 25 is attached at the bottom of striker support 26*b* with a screw (not shown). Striker support 26*b* provides a rigid connection from superior horizontal wind baffle 24 to striker 25.

In FIG. 1 an chime tether 31 is shown attached to bottom main chime support arms, chime support arm 28*a*, chime support arm 28*b* and chime support arm 28*c* extending down through a tether passthrough slot 30 to the top of a chime 27 supporting the chime 27. A multiplicity of tether passthrough slot 30 are aligned with chime support arm 28*a*, chime support arm 28*b*, chime support arm 28*c* and bottom main chime support arms by mounting in the wind baffle attachment 29.

In FIG. 1 the diameter of superior horizontal wind baffle 24 is sufficient to extend beyond hummingbird feeder 32 presenting sufficient surface area capturing the down air currents of a flying hummingbird in close proximity.

In FIG. 1 the distance between chime 27 and striker 25 is sufficiently small allowing striker 25 to strike chime 27.

In FIG. 1 striker 25 is located below the top of chime 27 allowing striker 25 to strike chime 27.

OPERATION—FIGS. 1, 2, AND 3

The Hummingbird Wind Chime with Superior Horizontal Wind Baffle and Rigidly attached Striker is hung from attachment loop in and outdoors area accessible to hummingbirds. Hummingbirds feed from the hummingbird feeder 32. Hummingbirds landing, taking off, and hovering in proximity of the feeder create air currents. These air currents act on the superior horizontal wind baffle 24. The superior horizontal wind baffle 24 communicates this force to the striker 25 resulting in swinging motion. The striker 25 strikes the chime 27 causing a tonal response. The hummingbird feeder attachment hook 23 provides a disengagement and re-engagement mechanism for the hummingbird feeder 32. The Hummingbird Wind Chime with Superior Horizontal Wind Baffle remains hanging while the hummingbird feeder 32 is removed for maintenance.

Natural air currents will also act on the superior horizontal wind baffle 24 causing the striker 25 to strike the chime 27's.

What is claimed is:

1. A wind chime assembly, comprising:

(a) a horizontal wind baffle for applied air currents to move said horizontal wind baffle (b) a striker located vertically below and communicating with said horizontal wind baffle (c) a plurality of chimes located within striking distance of said striker (d) a main frame (e) first means for anti-axial rotation support of said horizontal wind baffle from said main frame (f) second means for support of said striker from said horizontal wind baffle (g) third means for support of said plurality of chimes from said main frame (h) fourth means for support of said main frame from overhead structure whereby said horizontal wind baffle acted on by air currents created by birds or naturally communicates force to said striker which strikes said chimes invoking a tonal response.

2. A wind chime assembly, comprising:

(a) a horizontal wind baffle for applied air currents to move said horizontal wind baffle (b) a striker located vertically below and communicating with said horizontal wind baffle (c) a plurality of chimes located within striking distance of said striker (d) a main frame (e) first means for anti-axial rotation support of said horizontal wind baffle from said main frame (f) second means for rigid support of said striker from said horizontal wind baffle (g) third means for support of said plurality of chimes from said main frame passing through voids in the wind baffle (h) fourth means for support of said main frame from overhead structure whereby said wind baffle acted on by air currents created by birds or naturally communicates force to said striker which strikes said chimes invoking a tonal response.

* * * * *